US010752411B2

(12) United States Patent
Nini

(10) Patent No.: US 10,752,411 B2
(45) Date of Patent: Aug. 25, 2020

(54) CONTAINER FOR LIQUIDS EQUIPPED WITH DELIVERING PLUG WITH INTEGRATED AIR PASSAGE AND WARRANTY SEAL WITH AUTOMATIC OPENING

(71) Applicant: Vitop Moulding S.R.L., Alessandria (IT)

(72) Inventor: Diego Nini, Alessandria (IT)

(73) Assignee: Vitop Moulding S.R.L., Alessandria (IT)

( * ) Notice: Subject to any disclaimer, the term of this patent is extended or adjusted under 35 U.S.C. 154(b) by 0 days.

(21) Appl. No.: 16/608,058

(22) PCT Filed: Feb. 28, 2018

(86) PCT No.: PCT/IT2018/000026

§ 371 (c)(1),
(2) Date: Oct. 24, 2019

(87) PCT Pub. No.: WO2018/211536

PCT Pub. Date: Nov. 22, 2018

(65) Prior Publication Data

US 2020/0180825 A1 Jun. 11, 2020

(30) Foreign Application Priority Data

May 17, 2017 (IT) ..... 102017000053123

(51) Int. Cl.
*B65D 47/30* (2006.01)
*B65D 47/32* (2006.01)

(52) U.S. Cl.
CPC ..... *B65D 47/30* (2013.01); *B65D 47/32* (2013.01)

(58) Field of Classification Search
CPC ..... B65D 47/30; B65D 47/32; B65D 47/248244; B65D 47/245
USPC ..... 222/551, 552–555, 544–548, 559–561; 220/711, 714, 715, 203.11–203.14, 220/203.17–203.19
See application file for complete search history.

(56) References Cited

U.S. PATENT DOCUMENTS 6,491,189 B2 * 12/2002 Friedman ..... B65D 47/248 222/509
7,040,514 B2 * 5/2006 Colan ..... B67D 1/0456 222/402.13
8,272,532 B2 * 9/2012 Michaelian ..... A47G 19/2272 137/630.14

(Continued)

FOREIGN PATENT DOCUMENTS

CA 2948174 A1 * 11/2015

*Primary Examiner* — Lien M Ngo
(74) *Attorney, Agent, or Firm* — Young Basile Hanlon & MacFarlane, P.C.

(57) ABSTRACT

A container for liquids equipped with delivering plug comprises: a main body placed at the delivery end of the container, a lower closing piston inside the main body, from the side oriented towards inside the container, and an upper cover with collapsible membrane/push-button placed inside the main body, from the side oriented towards outside the container; the upper cover with collapsible membrane/push-button fastened to the main body comprises a central push-button equipped with internal weakening points, to allow deforming the central push-button passing from a closing position to a stable using/opening position.

7 Claims, 18 Drawing Sheets

(56) References Cited

U.S. PATENT DOCUMENTS

| | | | | |
|---|---|---|---|---|
| 9,708,108 | B2 * | 7/2017 | Gregory | A47G 19/2272 |
| 10,065,849 | B2 * | 9/2018 | Van Der Molen | B67D 3/045 |
| 2002/0121531 | A1 * | 9/2002 | Stillinger | B65D 47/248 222/525 |
| 2003/0209574 | A1 * | 11/2003 | Lin | B65D 41/28 222/548 |
| 2007/0181615 | A1 * | 8/2007 | Allanson | F16K 23/00 222/518 |
| 2009/0250461 | A1 * | 10/2009 | Syrkos | B65D 47/248 220/254.1 |
| 2010/0200602 | A1 * | 8/2010 | Chan | A47G 19/2272 220/714 |

* cited by examiner

CONTAINER FOR LIQUIDS EQUIPPED WITH DELIVERING PLUG WITH INTEGRATED AIR PASSAGE AND WARRANTY SEAL WITH AUTOMATIC OPENING

CROSS REFERENCE TO RELATED APPLICATION

The present application claims priority to Italian Patent App. No. 102017000053123, filed May 17, 2017, incorporated herein in its entirety.

TECHNICAL FIELD

The present invention refers to a container for liquids, drinkable or not, equipped with delivering plug, such container being of the rigid, semi-rigid (preferably) or flexible type. In particular, the present invention refers to a container for drinkable liquids equipped with delivering plug with integrated air passage and warranty seal with automatic opening.

BACKGROUND

Purpose of the present invention is creating a delivering plug with automatic opening with a "tamper evident" system which is completely made of plastic material (therefore, easily recyclable) and which can be adapted to containers already present on the market, actually replacing the currently marketed old plug versions.

Especially, a specific integration is required, both at aesthetic level, and as management of the plug inside the manufacturing cycle, regarding the container for soy sauce marketed by company Kikkoman, which, several years ago, launched on the market a container which would have become a "guide" and leader of all other soy producers, with sales of more than 300 millions of pieces since its creation in 1961. The plug of the invention, therefore, is integrated without damaging/changing the aesthetic level of the above Kikkoman dispenser.

The present invention will therefore be described as example of integration/adaptation of the new concept of delivering plug to the Kikkoman soy dispenser, since this is the most complex example to make, because one has to integrate a new concept to an existing system. Such solution however will be only an example, but will not be a limitation of the inventive concept of the present application.

Such inventive concept can be adapted to any type of container/product existing on the market.

Therefore, as regards the plug manufactured and marketed by the company Kikkoman, with reference to FIGS. 16, 17 and 18, it has an operating/actuation principle of this type by the end user at its first opening:

Step 1: removing the external heat-shrinkable sleeve (not shown) which covers the whole plug;

Step 2: removing the plug 0.1;

Step 3: removing the plug 0.5, which is the main seal during transport and storage;

Step 4: checking for the presence of the OR-ring 0.6;

Step 5: re-screwing the plug onto the bottle and using it.

Such plug which, observing FIG. 16, is formed of five pieces (external heat shrinkable sleeve, upper plug 0.1, main body 0.3, washer/OR-ring 0.6 and lower sealing plug 0.5) however has some defects:

it is a very costly plug formed of several parts/pieces;

as regards the molding cost, some parts like the main body 0.3 are geometrically over-dimensioned as regards the level of used plastic: in practice, the piece can be enlightened (and it is what occurs in the delivering plug of the present invention) in order to optimize the weight and, consequently, having less plastics, also its production cycle, with a very quick and therefore less costly injection molding;

consequently, it has a very high production and assembly cost;

the presence and the need of having an external heat shrinkable sleeve is the only warranty of not opening and not counterfeiting the product, only at its first opening; moreover, the sleeve must be applied afterwards, after having filled the bottle and screwed the plug. This additional step complicates and slows down the production process;

moreover, the sleeve, once removed, will have to be dispensed of with a further operation required for the end customer/user.

The plug produced and marketed by company Kikkoman is not easily used and not immediately understood, due to the multiple assembled parts to guarantee its seal.

The plug, before its use (first use) must be prepared. For a better understanding, to start delivering the product, it is necessary to unscrew the plug and remove the part 0.5 (FIGS. 16, 17 and 18).

Also in this case, the end user is requested to perform an additional operation for managing the disposal of the removed plug.

Sometimes, removing the plug, which is a necessary operation during the first use, the washer/OR-ring 0.6 is lost, and therefore the plug, once being screwed again onto the bottle, not having the intermediate sealing element 0.6 anymore, will cause liquid leakages between bottle and remaining plug assembly.

Moreover, it will be possible to re-use the container by filling it again with a counterfeited liquid without any guarantee of genuineness for the end user.

Such plugs have no real warranty seals capable of pointing out a counterfeiting or a simple opening, but only a small "dust preventing" plug, whose purpose is protecting the product contained in the bottle from dust or dirt. Currently, therefore, there is no warranty (apart from the first use, since there is the heat shrinkable sleeve) against counterfeiting the product contained in the bottle, because the small plug can be easily removed and re-inserted without the end user becoming aware of this: therefore, counterfeited products can be distributed without any problem and above all without an awareness of the end user.

Documents US-A1-2007/181615, U.S. Pat. No. 5,299,718, US-A1-2009/250461 and US-A1-2011/174842 disclose containers of liquids equipped with plugs according to the preamble of claim 1.

SUMMARY

Object of the present invention is providing an innovative and simple plug, which can be immediately used by an end user, which is eco-compatible, and has a system which allows the customer to point out a product counterfeiting, and which however allows being adapted to containers present on the marked, not requiring modifications regarding aesthetics or its manufacturing process.

A further object of the present invention is providing a plug with automatic opening from the transport/storage position to the "open" position for delivering the product, without having to unscrew and remove components from the plug, as occurs in the original, currently marketed plug.

Another object of the present invention is having an integrated system which allows the end user to see whether the plug has been opened or not, and therefore having a "tamper evident" system integrated on the new plug. In the currently marketed version, the plug, once put in its opening position (the, sleeve and lower plug are removed at its first opening), allows, after having ended the food product contained in the container, opening it again and filling it with an even potentially counterfeited product.

A further object of the present invention is having a fastening system onto the bottle which does not allow removing the plug (and therefore the potential product counterfeiting).

Another object of the present invention is having a plug which can be adapted to an existing system, and therefore with the possibility of screwing the plug onto an existing container, to be perfectly suited to the existing solution both at an aesthetic and at a functional level.

A further object of the present invention is having an evolved liquid sealing system integrated to the plug, in order to remove the risk of having an additional component (OR-ring like in the currently marketed plug) which could then get lost.

Another object of the present invention is reducing to a minimum the components forming the plug, without changing its functional features.

A further object of the present invention is having a plug with two or more outlets, so that one is used as liquid outlet and the other one as air inlet, to allow a continuous delivery of the liquid extracted from rigid or semi-rigid containers.

Another object of the present invention is having a plug device which can be easily managed, which minimizes the amount of parts to be managed and disposed of.

The above and other objects and advantages of the invention, as will appear from the following description, are obtained with a delivering plug as claimed in claim 1. Preferred embodiments and non-trivial variations of the present invention are the subject matter of the dependent claims.

It is intended that all enclosed claims are an integral part of the present description.

The inventive plug, being provided with a high oxygen barrier, is suitable for aseptic applications.

The present invention will be better described by some preferred embodiments thereof, provided as a non-limiting example, with reference to the enclosed drawings, in which:

DETAILED DESCRIPTION

With reference to the Figures, a non-limiting example of embodiment of the delivering plug 1 of the invention is shown and described. It will be clear to a skilled person in the art that the described delivering plug can be made with equivalent shapes, sizes and parts, and can be used for various types of containers, rigid or semi-rigid or other, always falling within the scope of the present invention.

Figure 1:
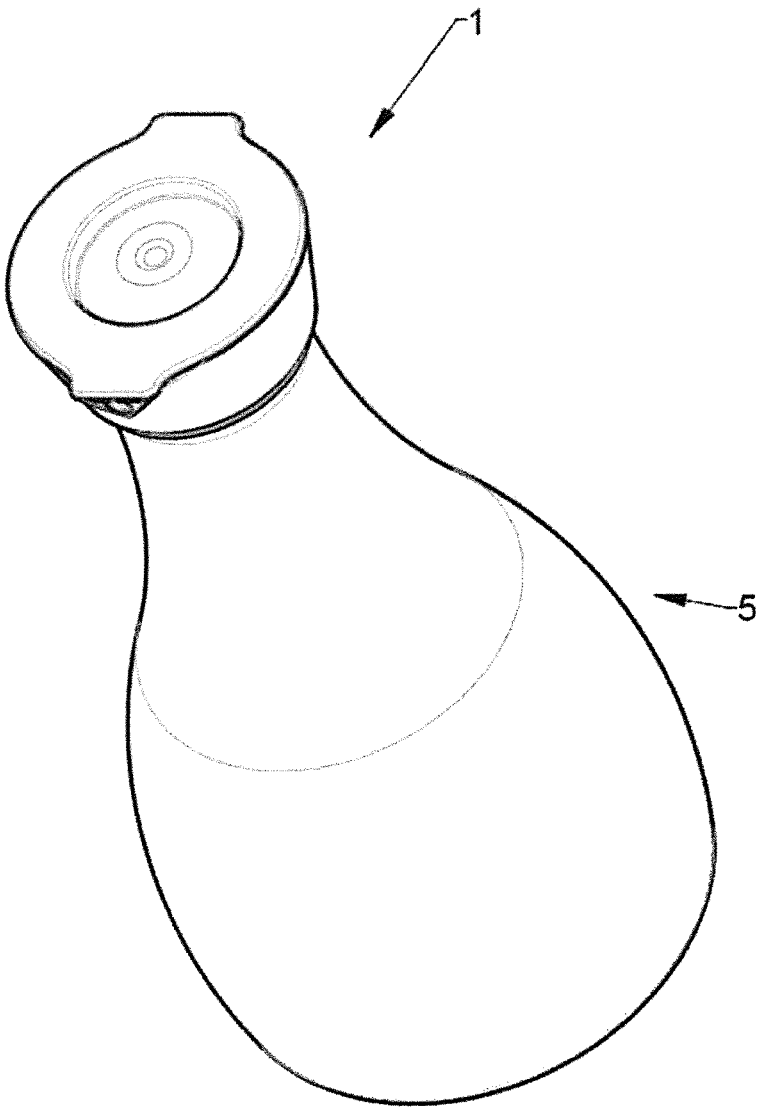
FIG. 1 is a perspective view of an embodiment of the inventive delivering plug and of the container with removal-preventing system according to the present invention.
Figure 2:
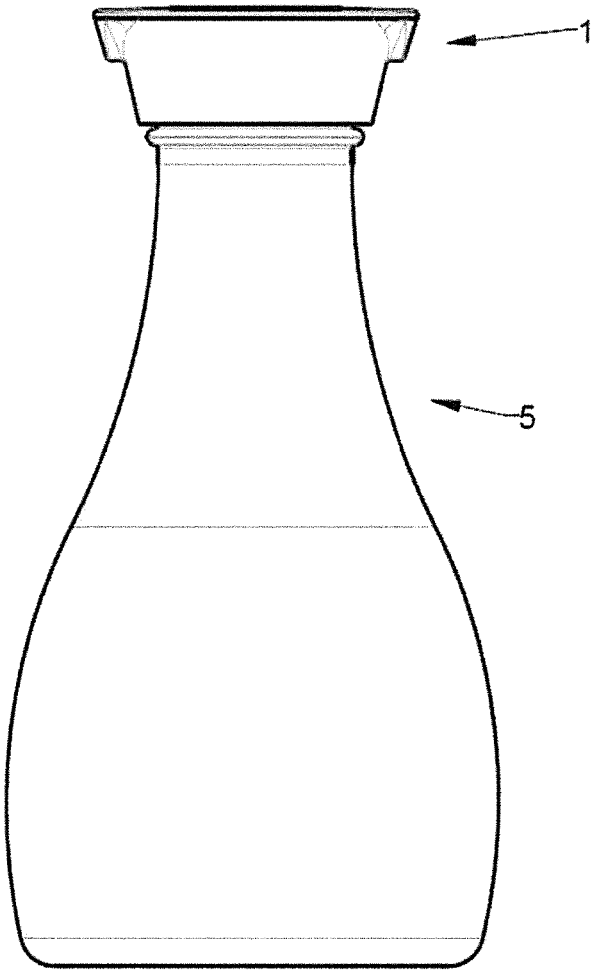
FIG. 2 is a side view of an embodiment of the inventive delivering plug and of the container with removal-preventing and anti-counterfeiting system according to the present invention.
Figure 3:
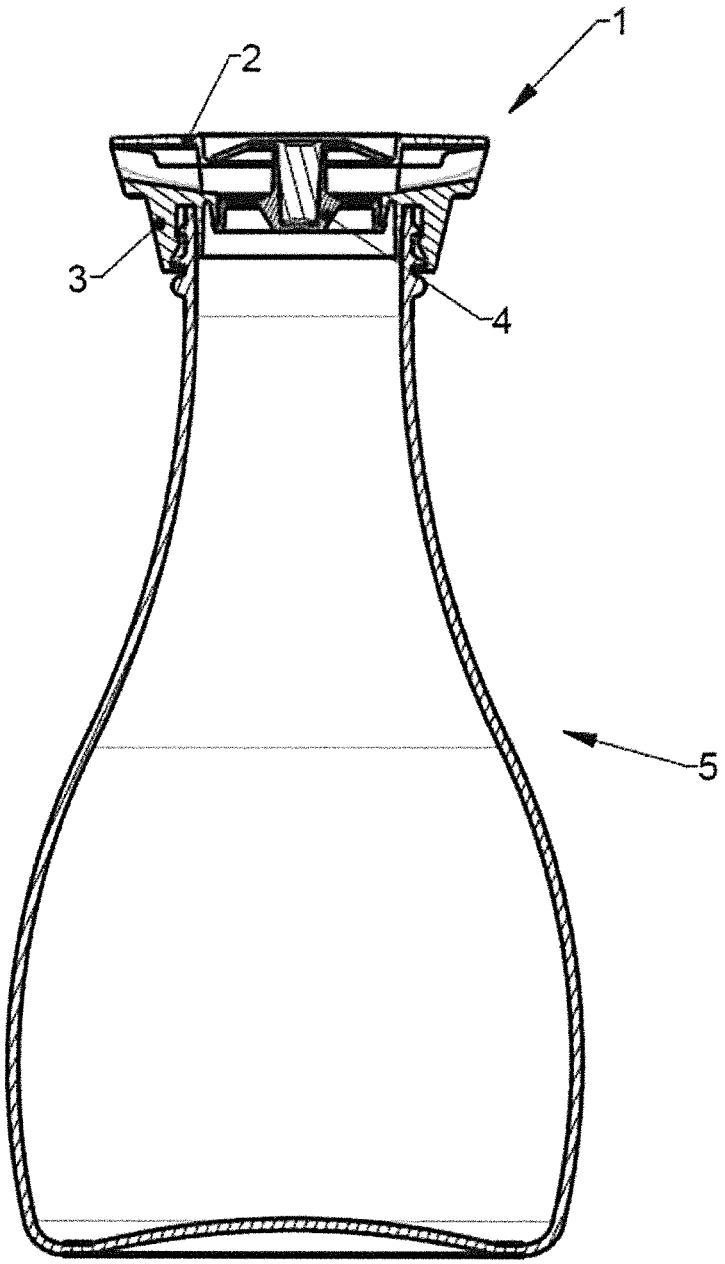
FIG. 3 is a sectional view of the assembled delivering plug of FIG. 1.
Figure 4:
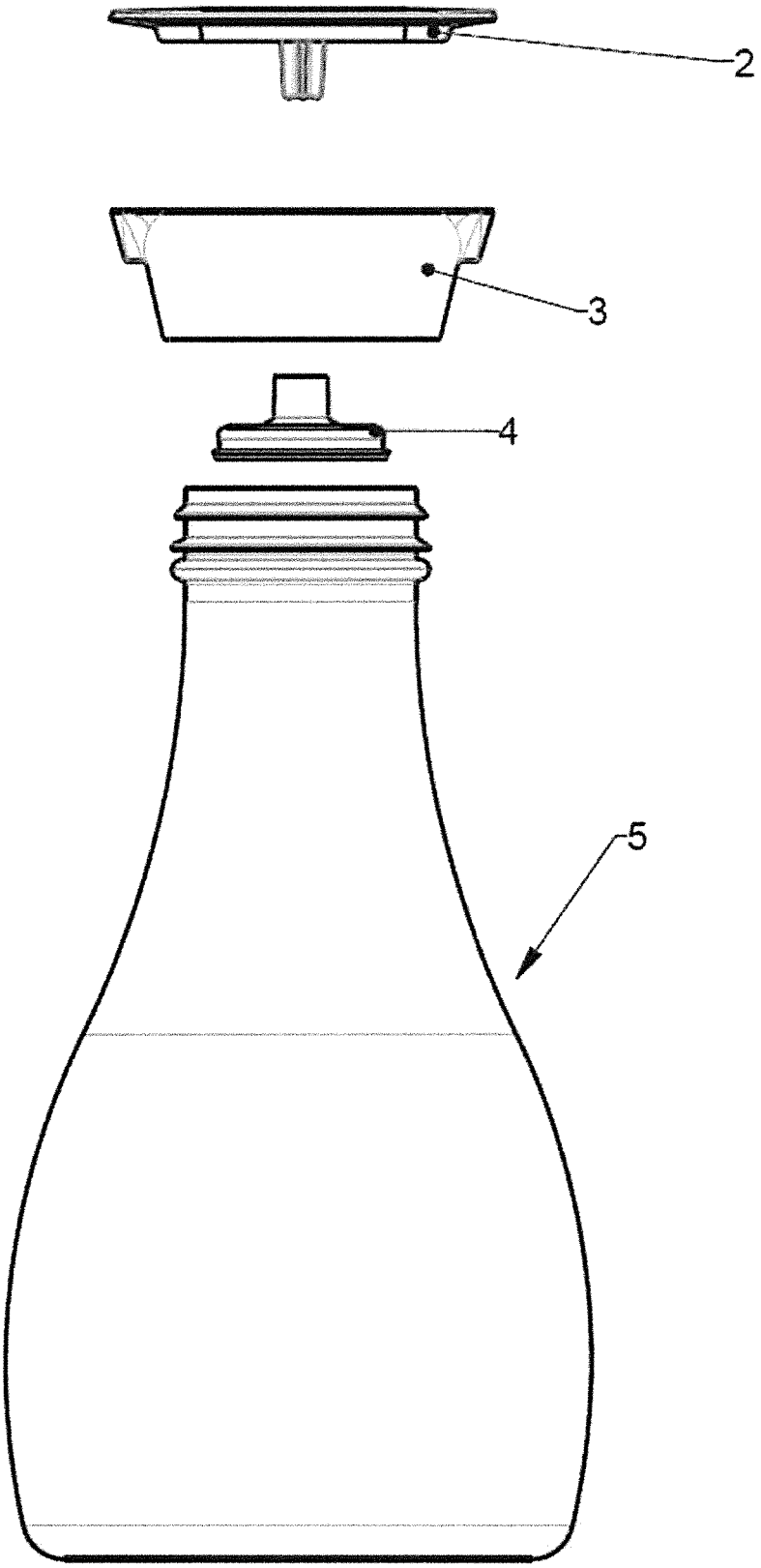
FIG. 4 is an exploded view of the inventive delivering plug and of the container with removal-preventing system and of the container with removal-preventing system of FIG. 1.
Figure 5:
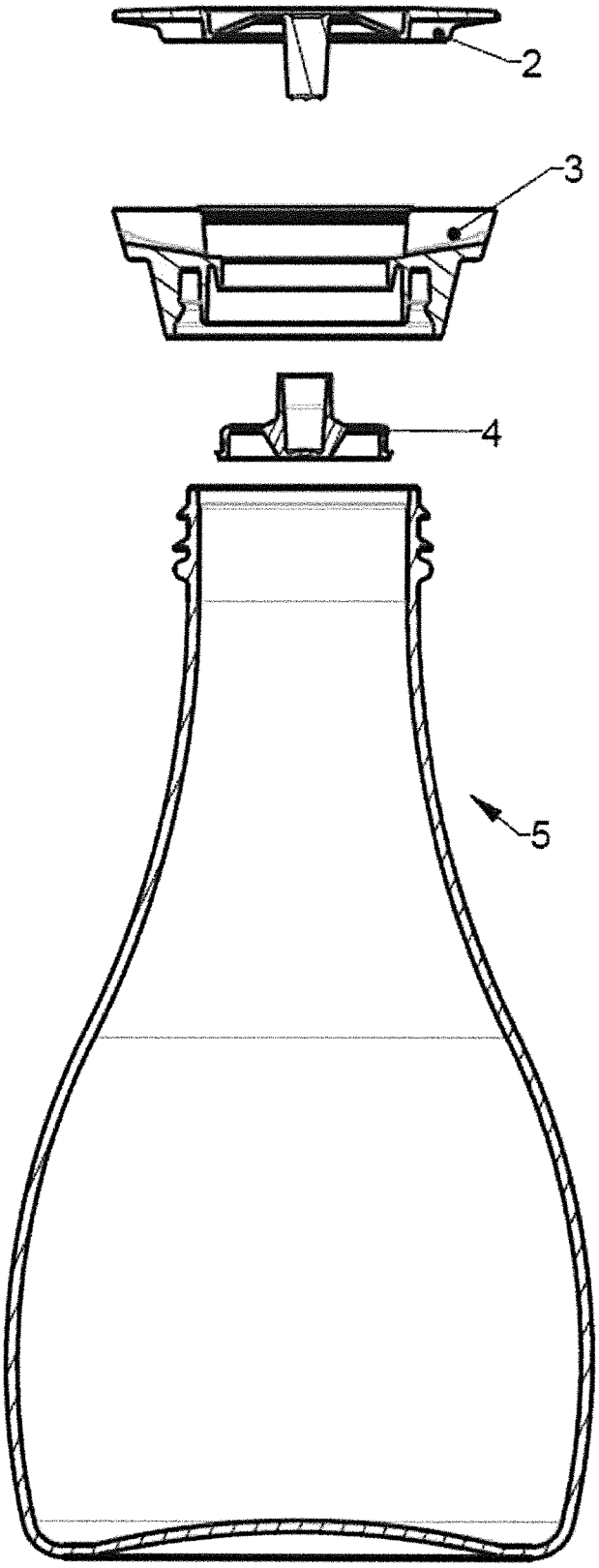
FIG. 5 is an exploded sectional view of the inventive delivering plug assembly and of the container with removal-preventing system of FIG. 1.

With reference to the Figures, and in particular to FIGS. 1, 2 and 3, the delivering plug 1 of the invention, in its configuration with pressure fastening, associated with a container 5 with the removal-preventing/anti-counterfeiting geometries, is used for delivering liquids from a container, and substantially comprises:

a main body 3 placed at the delivery end of the container 5;

a lower closing piston 4 placed inside the main body 3 from the side oriented towards inside the container 5; and a collapsible membrane/push-button 2 controlled on its central part, placed inside the main body 3 from the side oriented towards outside the container 5.

Figure 6:
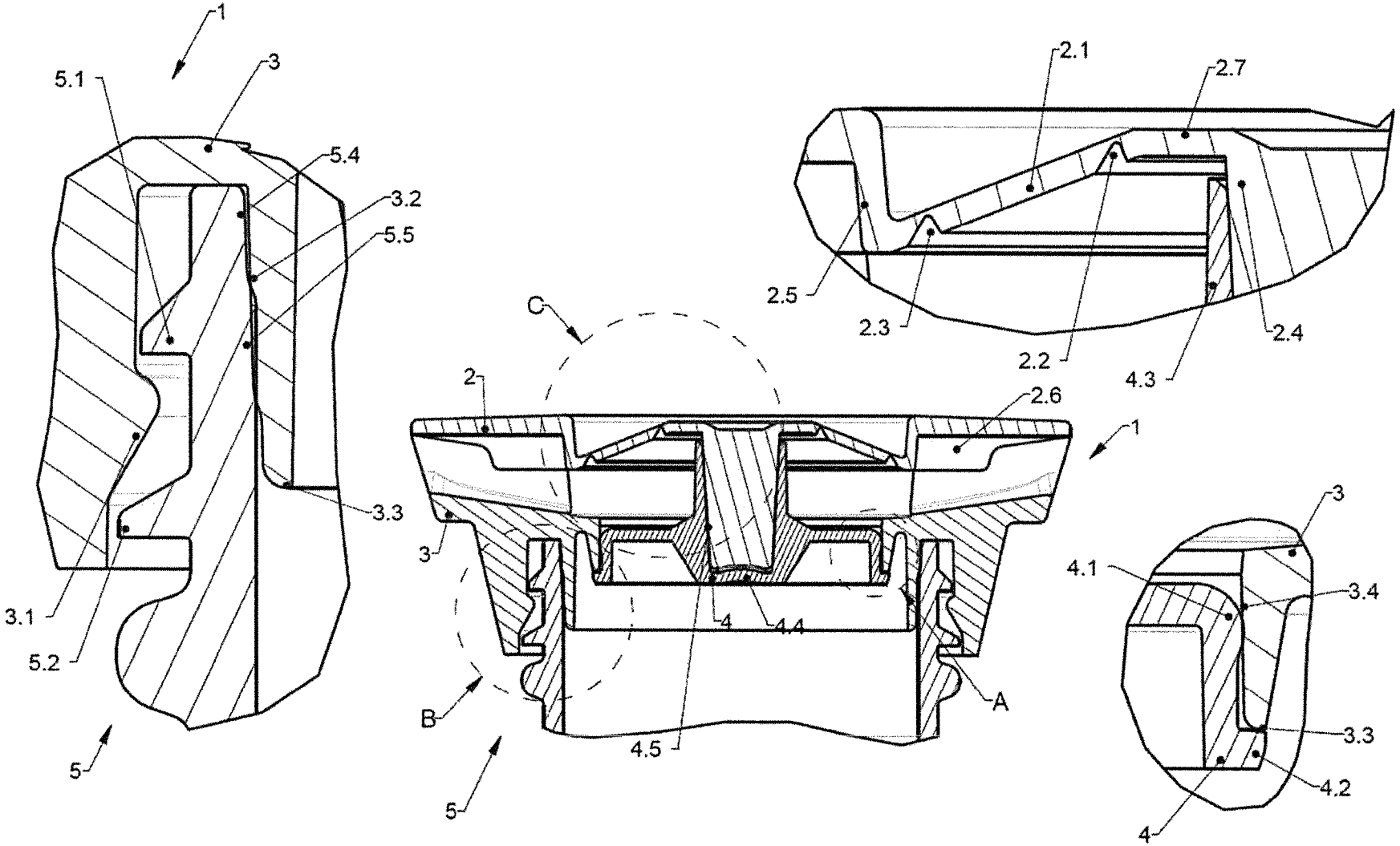
FIG. 6 is a detailed sectional view in a closing/storage/transport position of the inventive plug and of the container with removal-preventing system of FIG. 1.

With reference to FIG. 6, several details and sectioned images can be seen, which clearly show the configuration of the inventive plug 1 with the main body 3 (FIG. 9) with a fitting configuration 3.1 (FIG. 6) on the neck of the container 5, with the removal-preventing geometry 5.1 and the plugcentering geometry 5.2 (FIG. 6) assembled and in their operating closing/transport position.

The main body 3 is in its sealing position with the neck of the container 5 due to the operatively coupled geometries 3.2 and 5.5. The geometry 5.3 is used not to change anything at bottle handling level within the current production cycle of the dispenser, and therefore such geometry will fully comply with size and position of the original container, as will be described below.

The lower piston 4 is placed in its operating position on the body 3 due to the interference between the geometries 4.1 and 3.4, which are placed in the correct sealing position due to the step 4.2, which collides with the small lip 3.3 of the body 3.

As can be noted in the upper part of the piston 4, there is a guiding cylinder 4.3 which operates as seat for the lower part 2.4 of the upper cover with the collapsible push-button 2, and enables and guides its displacement/opening in its use position, as will be described below.

The upper cover with central collapsible push-button 2, which operates as "tamper evident", is placed on the main body 3, oriented due to the geometries 2.6, which determine the right position, and then it is stably welded to the main body 3 (hot or ultrasound welding). The upper cover has a central push-button 2.1 which, due to the internal weakening points 2.3 and 2.2, can move, due to the central pressure that the end user/customer performs, from the closing position shown in FIG. 6 to the use/opening position shown in FIG. 8, keeping this configuration, and therefore making the internal piston 4 remain open.

Figure 7:
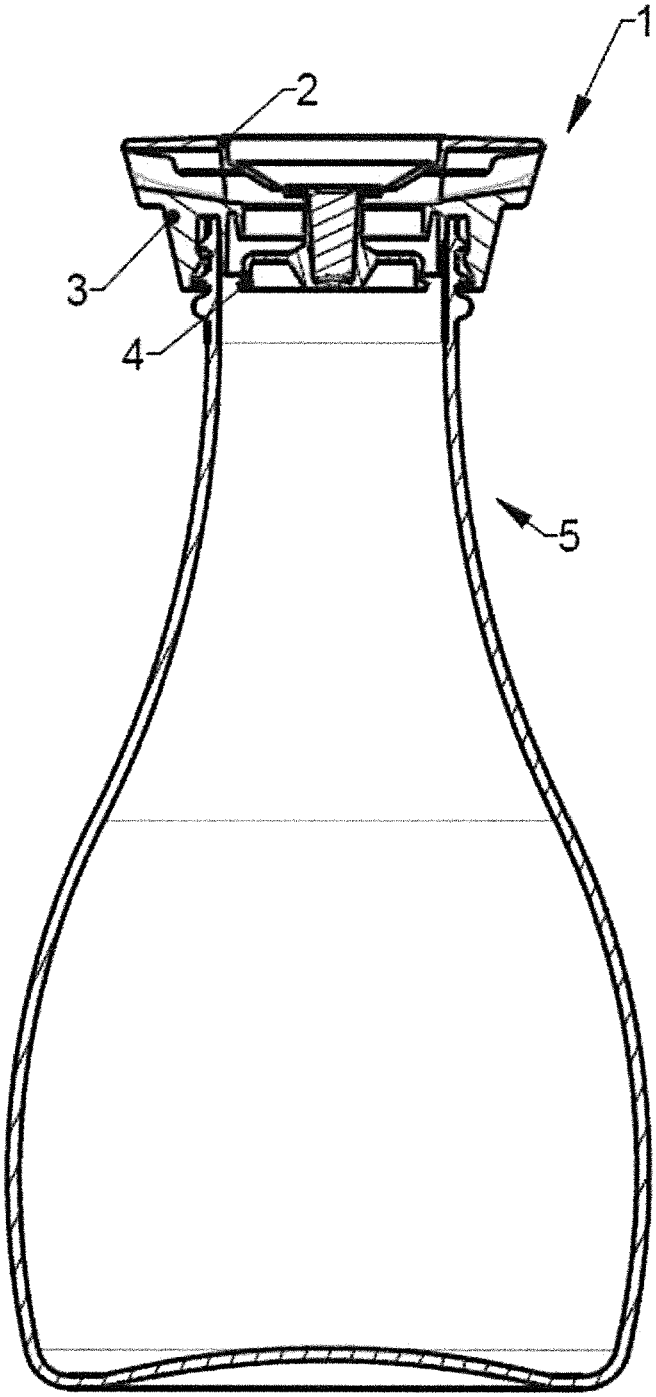
FIG. 7 is a side sectional view of the inventive delivering plug and of the container with removal-preventing system in the opening position of FIG. 1.
Figure 8:
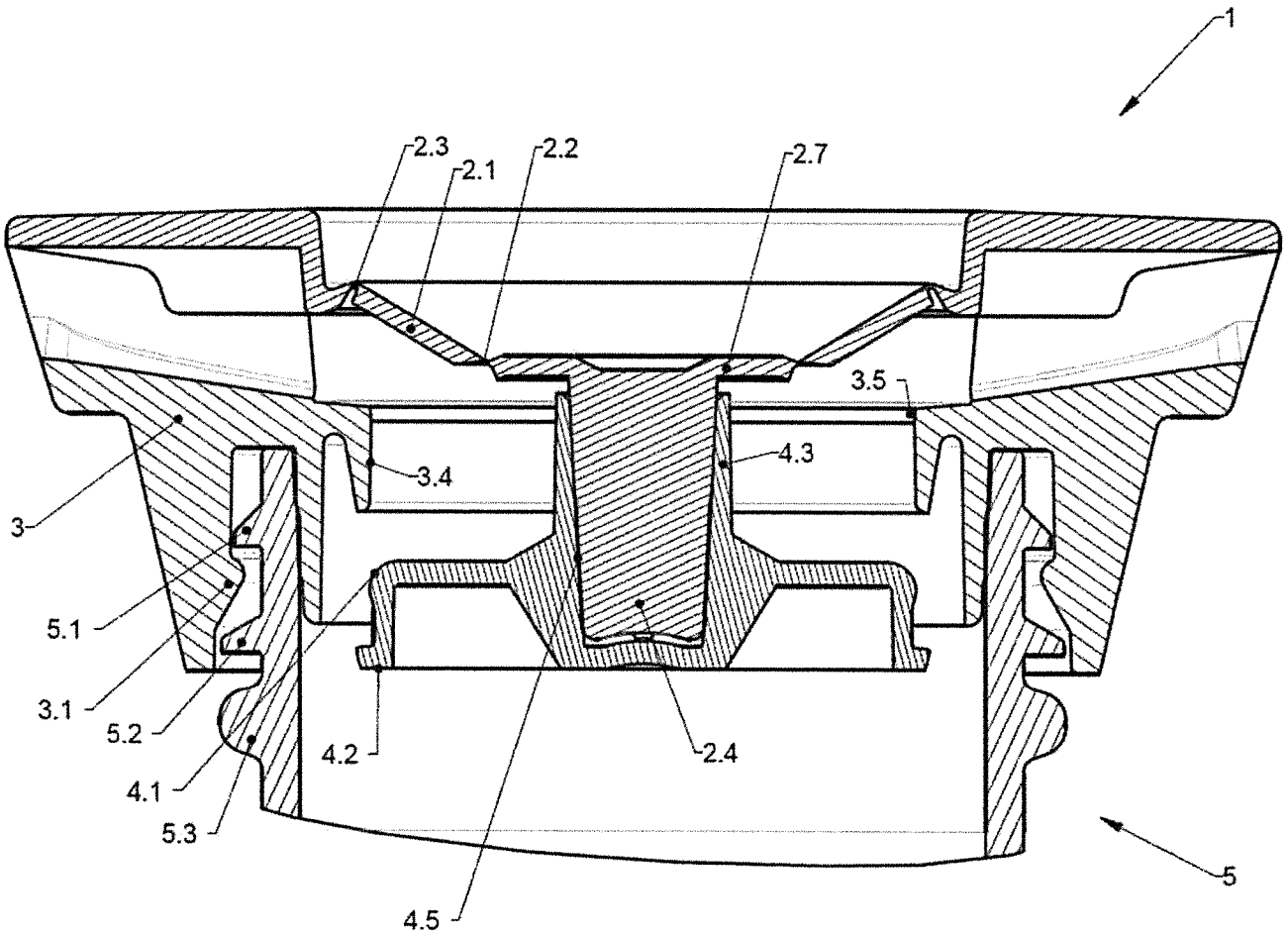
FIG. 8 is a detailed sectional view in its opening position of the inventive plug and of the container with removal-preventing system of FIG. 1.

FIG. 7 and FIG. 8 show the assembly of the inventive plug in section in its operating position, with the upper tamper evident element (central collapsible push-button) in its opening position and with evidence (for the end user) of the performed opening.

With reference to FIG. 8, is it possible to note that the pressure applied to the central push-button 2.7 of the upper plug 2 collapses it in controlled and symmetrical way. The weakening elements 2.2 and 2.3 allow an easy and controlled descent of the piston 4 due to the interference connection between the geometry 4.3 of the stem and the geometry 2.4 of the central push-button. The push-button, once collapsed in its opening position, remains stable in such position, providing three main benefits:

1. it will not be necessary any more to remove the plug to remove the internal protection as happened in the art (which will be described below with reference to FIGS. 16, 17 and 18) and therefore there will be an immediate and automatic opening of the dispenser, due to and guided by the controlled collapse of the upper membrane of the plug 2;

2. the central push-button will stably remain in its opening position and will keep the plug always open, without having to perform additional operations;

3. the user, especially for this version which provides for the fastening of the delivering plug system 1 to the special container 5 with removal-preventing/anti-counterfeiting geometries 5.1, obtains opening evidence and guarantees that the delivered products are healthy and original.

Figure 9:
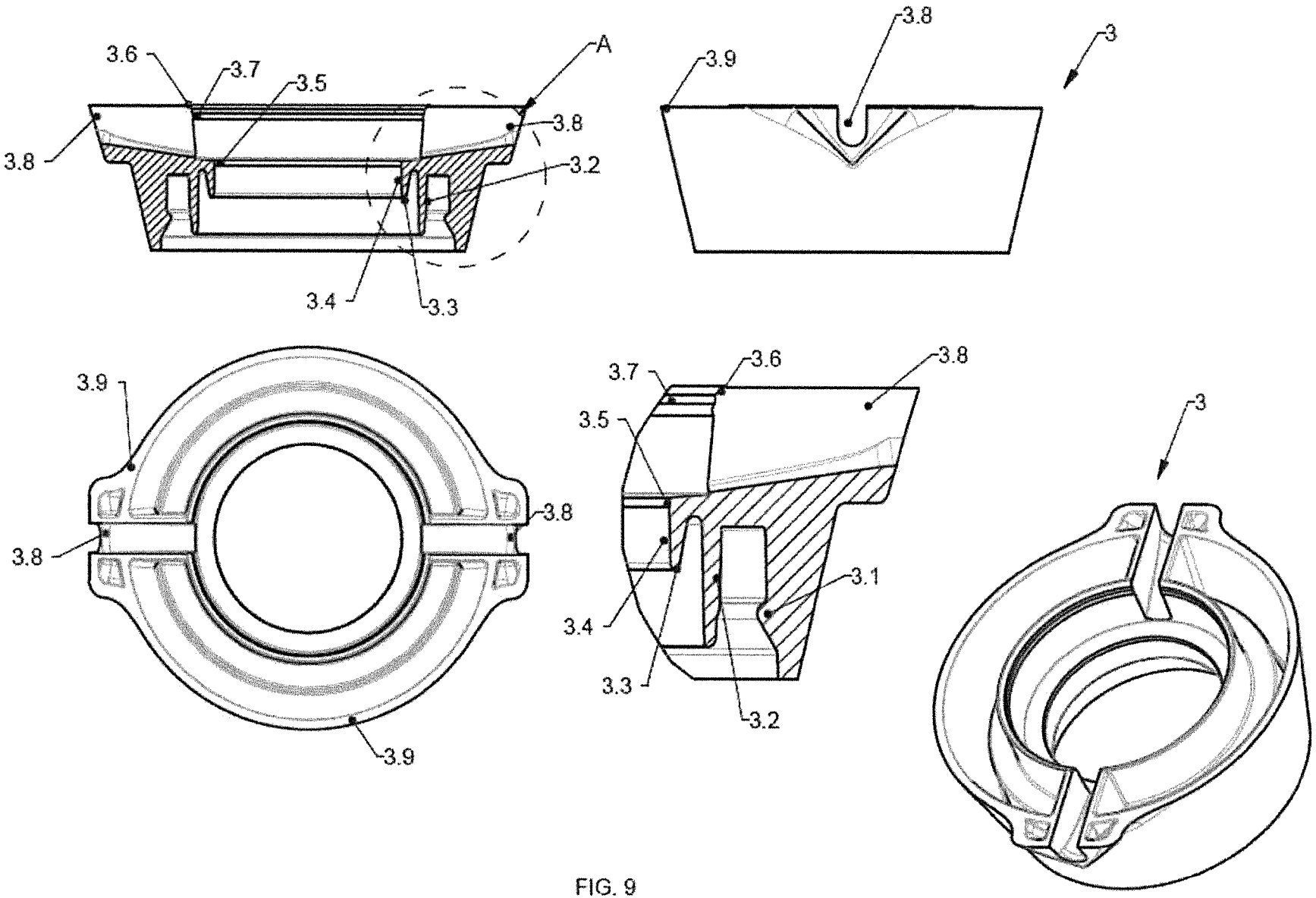
FIG. 9 is a front upper and sectional side view of the main body of the inventive plug 1 in its engaged configuration on a bottle beck on which there are the removal-preventing edge-type geometries of the plug.

With reference to FIG. 9, a first embodiment of the main body of the plug 1 will be described. This first embodiment is assembled stably and unmovably onto the container 5 with removal-preventing/anti-counterfeiting neck, creating a safe plug 1/container 5 system, safeguarding the consumer.

As can be noted, there are two elongated ends 3.8, which respectively operate as liquid outlet and/or air inlet according to how the liquid delivering container 5 is slanted. On the upper part of the main body 3, there is a sealing ring 3.7 which cooperates, once assembled the plug 1, with the chute 2.5 of the upper plug 2 with collapsible membrane, performing an operating liquid seal between the two components.

A bit-type profile 3.6 is also shown, which operates as energy guiding element and allows the ultrasound welding on the internal plane 2.9 of the upper plug 2 with collapsible membrane. Internally, a central opening 3.5 can be observed, which cooperates in an operating seal with the lower piston 4 due to the geometries 4.1 and 3.4.

Figure 16:
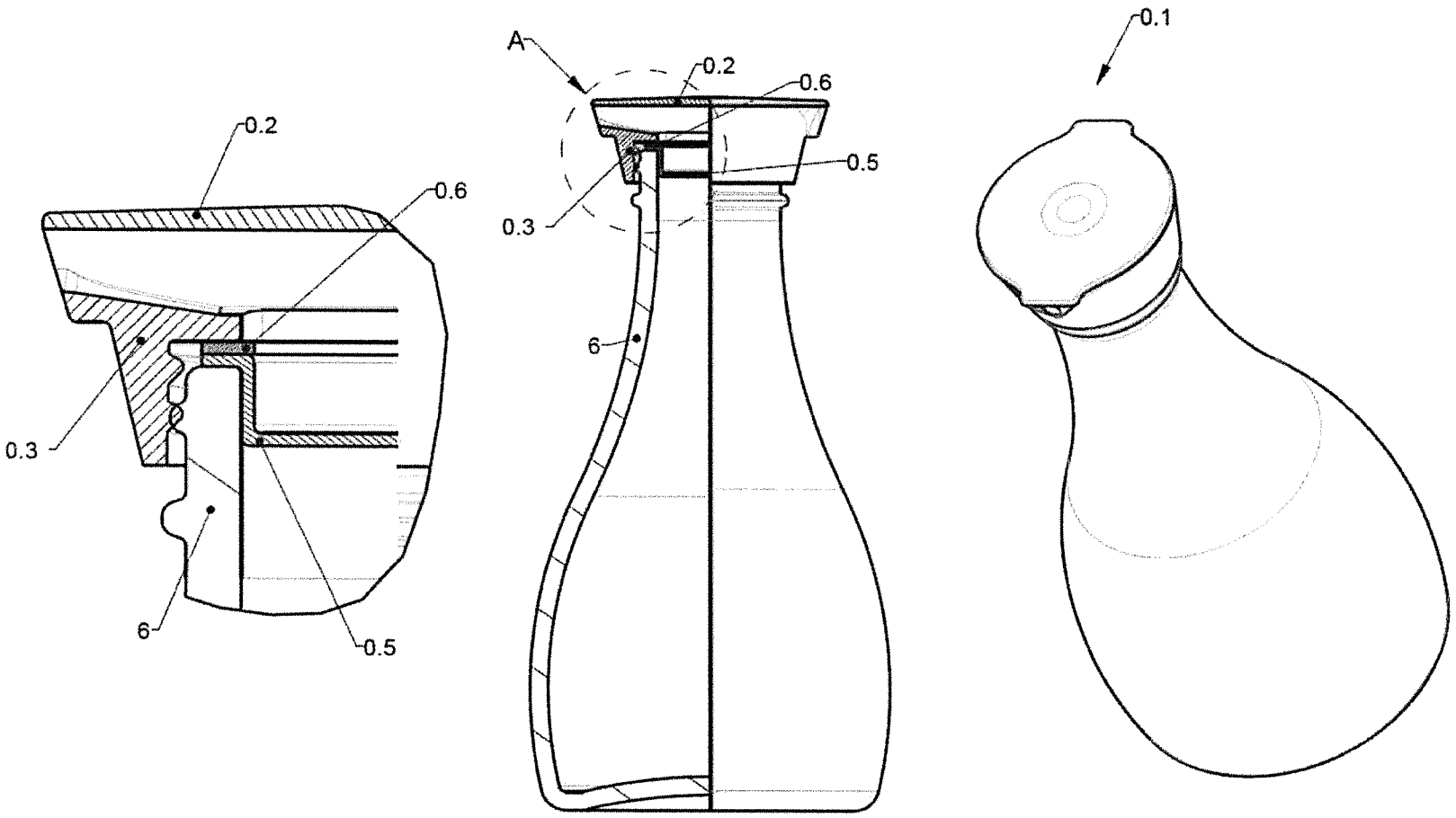
FIG. 16 is a series of views of the inventive plug in its screwing version in the closing/transport/storage position.
Figure 17:
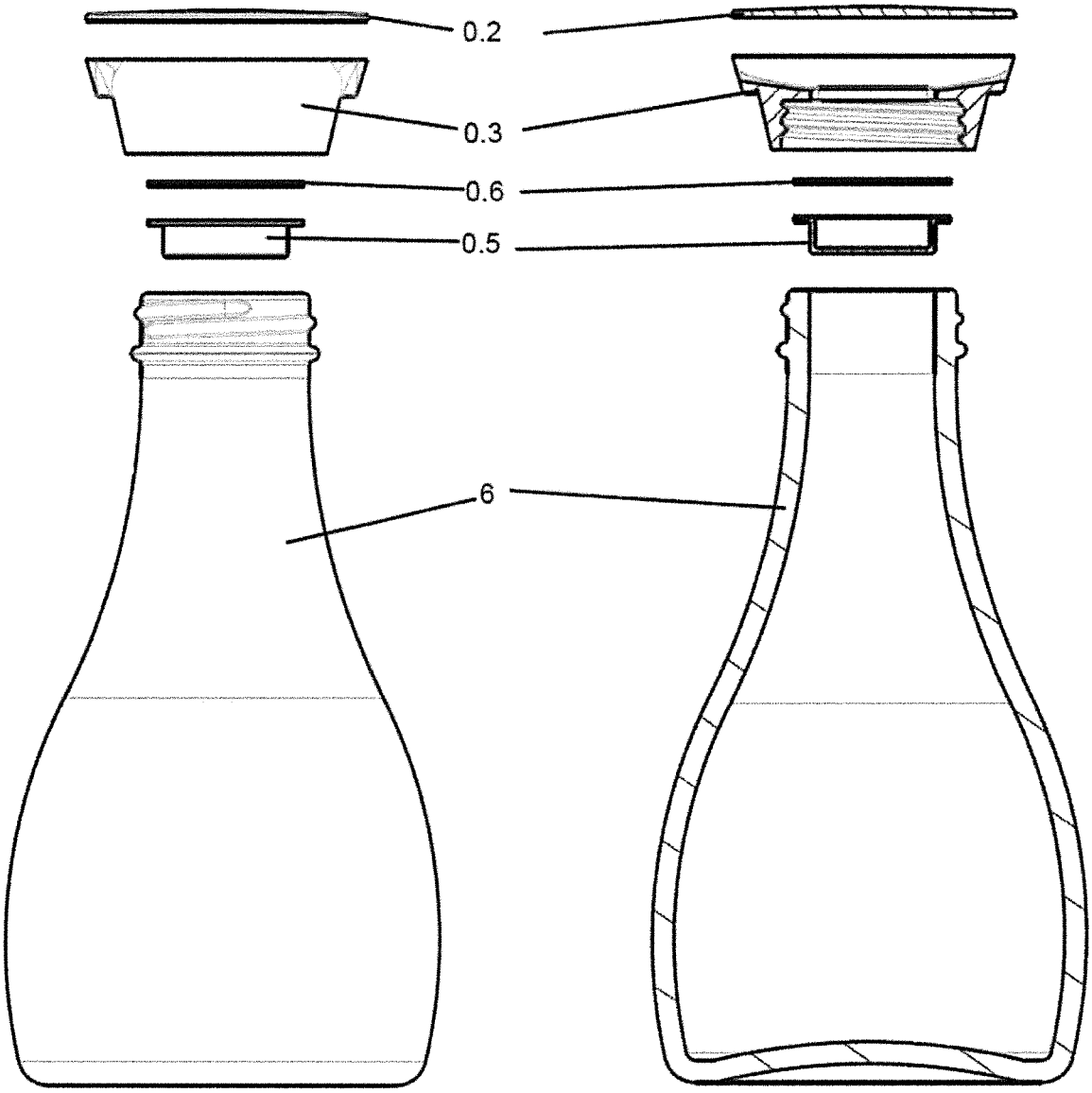
FIG. 17 is an exploded and sectional view of the currently marketed plug and container.
Figure 18:
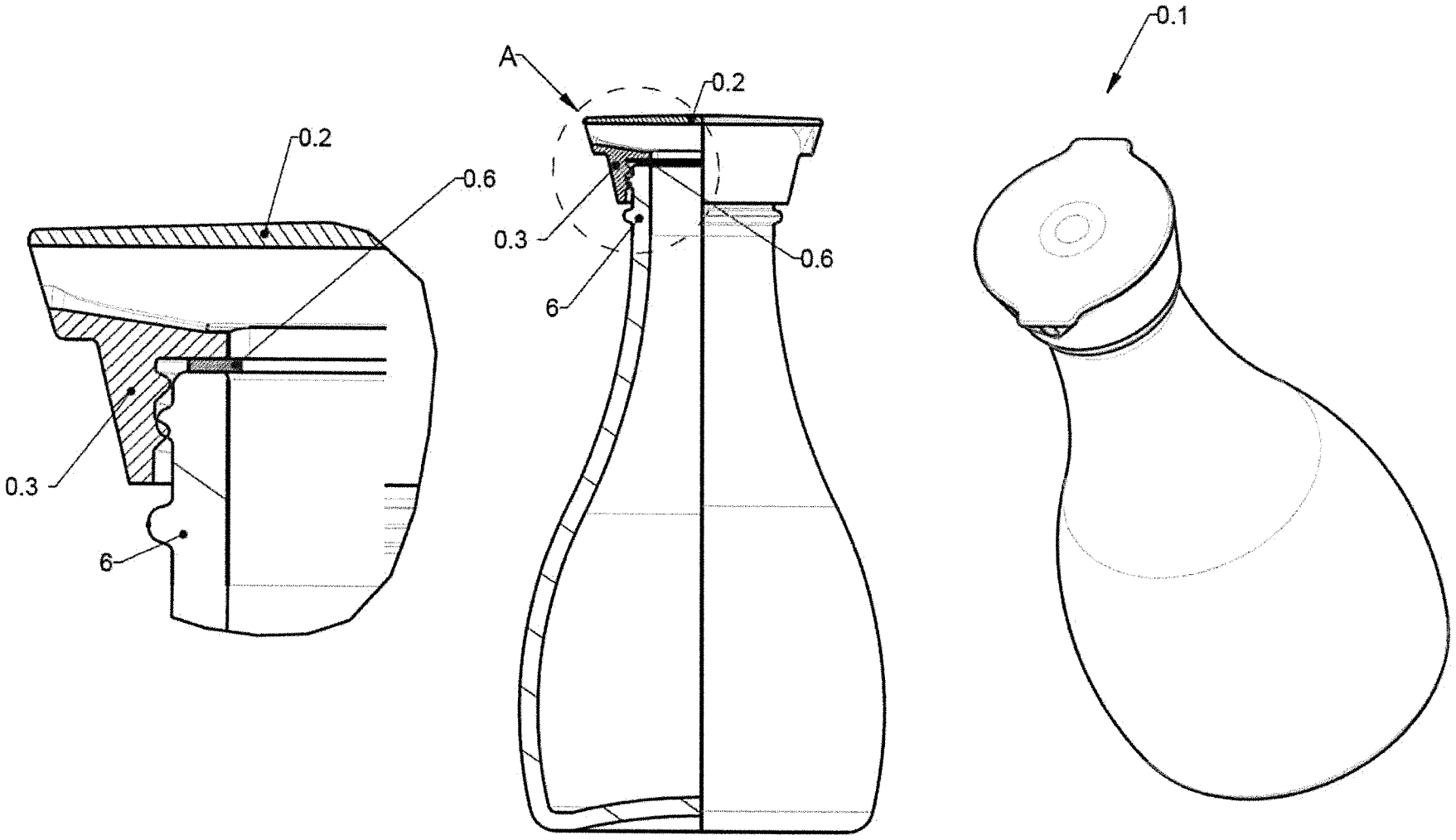
FIG. 18 is a series of views of the marketed plug in its screwing version in the opening position.

On the lower side, the fastening tooth 3.1 can be seen, which is stably and operatively connected to the removal-preventing geometries 5.1 created on the special neck of the container (bottle) 5. Moreover, the main internal sealing cone 3.2 can be noted, which cooperates, in its operating sealing position, with the internal diameter 5.5 of the neck of the bottle 5, generating a liquid seal without the need of using additional OR-rings, as instead occurs in the currently marketed version (FIGS. 16, 17 and 18).

Figure 10:
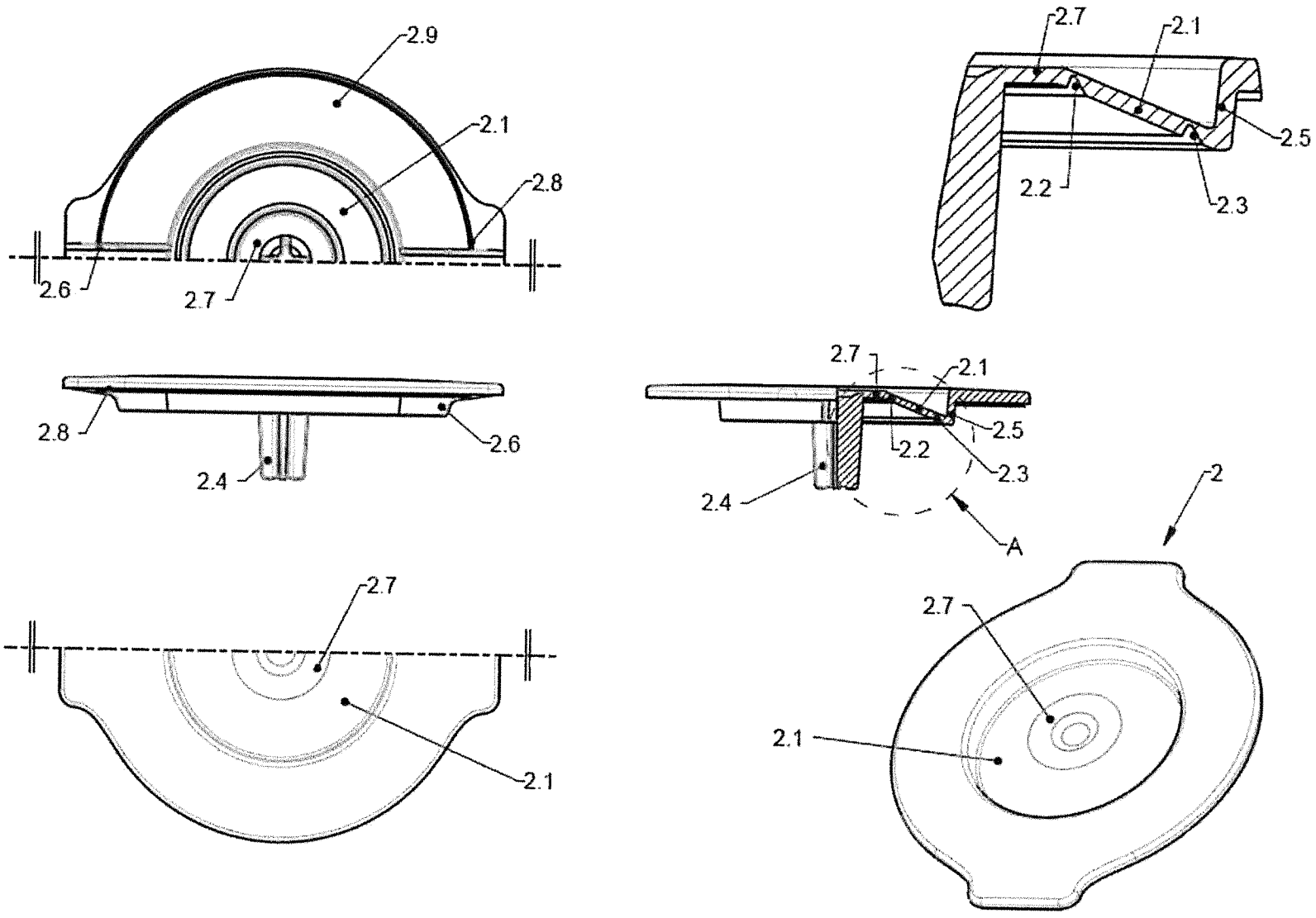
FIG. 10 is an upper and sectional front side view of the upper plug on which there is the special geometry with "tamper evident" flexible collapsible membrane.

With reference to FIG. 10, the innovative part of the delivering plug will be described, namely the upper plug 2 with flexible membrane with controlled deformation. As can be noted, it comprises a plane geometry 2.9, on which the seat of the central push-button 2.5 has been obtained, which in this case is given by a non-limiting geometry with controlled collapse with two internal weakening points 2.2 and 2.3; however, the push-button can also be shaped in other ways, obtaining the same result and always falling within the scope of the invention, for example of the dome type (not shown), which, in this case, coincides internally with the liquid sealing area between the chute 2.5 and the sealing ring obtained on the body 3, specifically in the geometry 3.7, and also coincides with the protection area from accidental openings of the push-button. Such protection can be also integrated with an additional (optional) piece called seal (not shown), which further protects the collapsible push-button 2 from accidental openings, and simultaneously the two liquid outlet/air inlet holes from dust, which must be removed as first operation before actuating/opening the delivering plug. Alternatively, in place of the above described seal, which is optional and not shown, also the heat shrinkable sleeve (not shown) can be used.

With reference to FIGS. 6 and 8, the push-button is preferably shaped as a dome 2.7 and 2.1, with controlled collapsing due to the internal grooves (discharging/weakening elements) 2.2 and 2.3. Under the flexible dome, there is a stem geometry 2.4 which is operatively connected by interference with the upper cylinder 4.3 of the stem 4 inside it.

When the push-button is actuated by a finger thrust during the first opening of the container, the first part of the push-button 2.7, with under it the stem 2.4 operatively connected to the internal cylinder of the stem 4.3, is lowered, exploiting the internal reduction 2.2; once having reached the bending limit, the second edge 2.1 also moves, which is flexed due to the internal reduction 2.3 till it also reaches its bending limit. This movement determines the displacement of the internal stem 2.4, which, in turn, being operatively connected to the cylinder 4.3 of the stem 4, determines the opening and the stable and final position of the stem 4 and allows delivering the liquid.

This automatic procedure implies several advantages for the end user, since he will be able to open the dispenser automatically without having to perform boring and mechanical operations. Moreover, no wastes to be managed are generated, as instead occurs in the original plug, since the sleeve wastes have to be managed before and of the lower sealing plug 0.5 (FIGS. 16 and 17) after; moreover, it provides evidence of opening to the customer and above all provides the chance of using the container 5 with removal-preventing/anti-counterfeiting geometries of the plug 5.1.

On the lower part there is also another but-shaped energy guiding element 2.8, which abuts onto the plane geometry 3.9 of the main body 3. There are two walls 2.8, which are coupled with the liquid outlet/air inlet areas 3.8 of the plug 3, determining the complete liquid seal of the plug 2 on the main body 3 and above all the right orientation of the two assembled components, facilitating their assembling.

Figure 11:
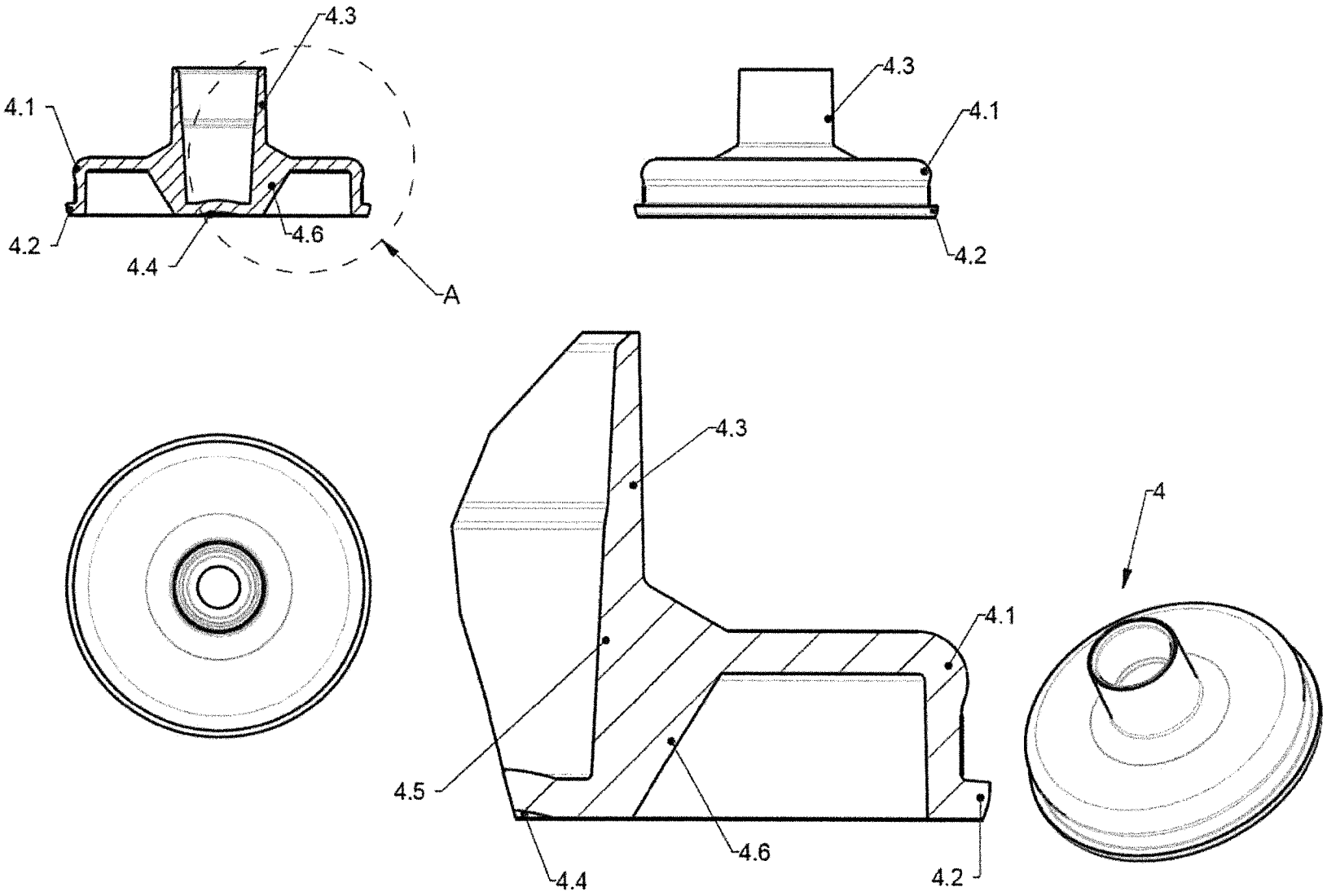
FIG. 11 is an upper and sectional front side view of the main closing valve of the inventive plug.

With reference to FIG. 11, the internal piston will be described, which determines the closing and opening of the delivering plug 1. Centrally, as described above, there is the guiding cylinder 4.3 which operates with the central stem, which is in the lower part of the flexible push-button 2.4 and interferes with the internal diameter 4.5.

Following on, there is the sealing area 4.1, which cooperates with the internal flexible lip 3.4 of the main body 3. There is a "stop" plate 4.2, which determines the right amount of seal of the area 4.1 inside the flexible lip 3.5 of the main body 3, colliding with the geometry 3.3. Inside the lower area, stiffening geometries 4.6 of the piece can be note, whose purpose is better transmitting the force (and therefore the movement) imposed by the flexible push-button 2.7 with controlled deformation, which is in the center of the part 2, enabling its opening during the first actuation.

Figure 12:
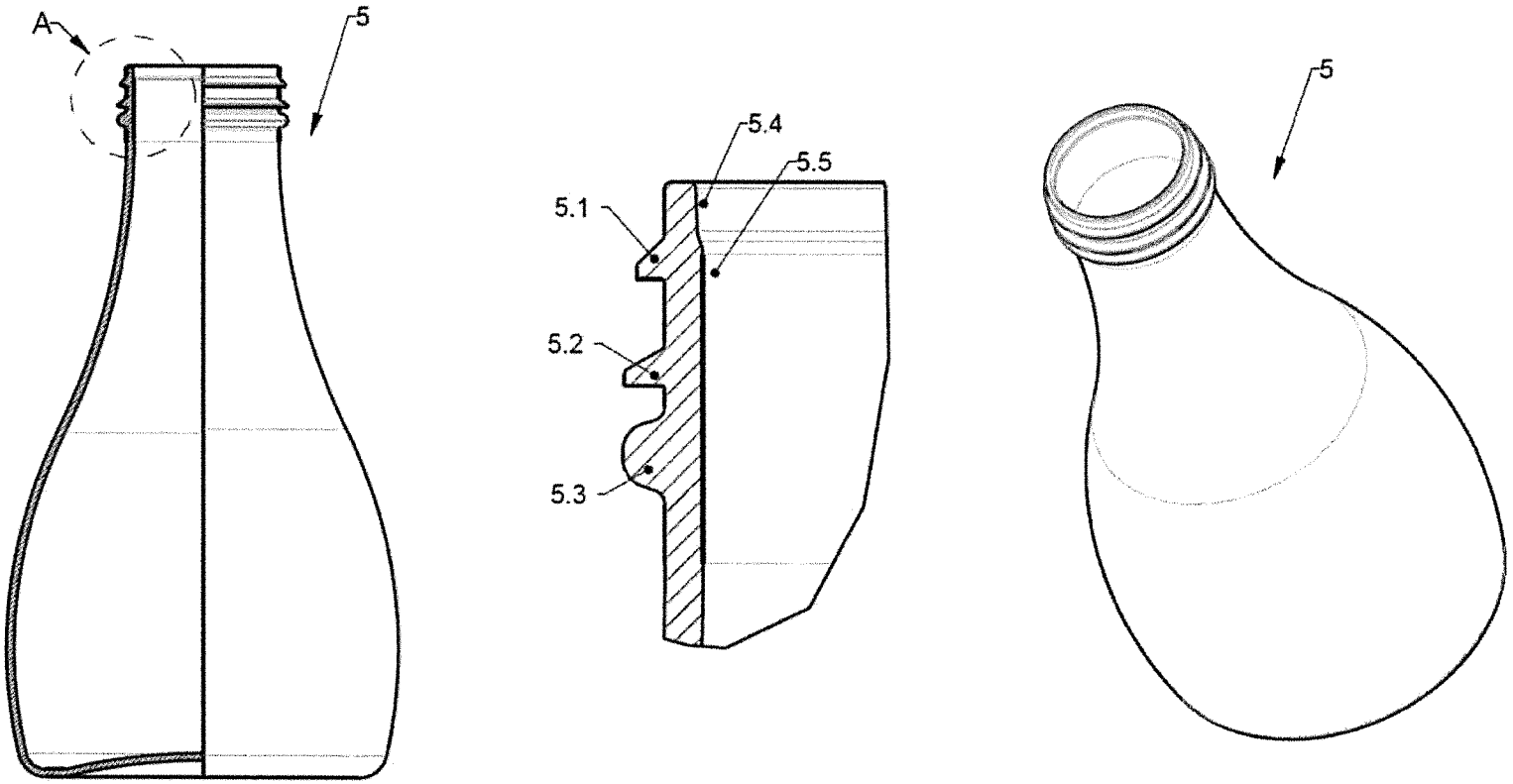
FIG. 12 is a detailed and sectional upper front side view of the inventive container with geometries with sharped edge, which allow the assembly to have the anti-counterfeiting and removal-preventing functions of the inventive plug.

With reference to FIG. 12, the bottle 5 with specific removal-preventing/anti-counterfeiting neck of the delivering plug 1 can be noted. Observing the detail of FIG. 12, it can be noted that there are two external teeth 5.1 and 5.2 with sharped edge and one tooth 5.3 with spherical section, which is identical, regarding size, geometry and position, to the one that is currently found on marketed bottles, and which is used to avoid having to modify the existing production cycle in any way. The tooth 5.2 is used to keep the plug 1 in position and axial, while the tooth 5.1 cooperates with the internal tooth 3.1 of the main body 3, guaranteeing its seal and above all the removal-preventing of the delivering plug 1 itself.

Internally, a reduction 5.4 can be noted of the internal diameter as safeguard of the sealing diameter 5.5. Possible defects of the bottle neck stop in the internal area 5.4 and do not enter the sealing area 5.5 of the delivering plug 1 for the bottle 5.

Due to eco-compatibility reasons, it is preferable to have a bottle 5 made of PET, in order to have a dispenser completely made of plastics and enable its recycling. Such bottle 5 can however be produced also with other materials (for example glass) and always fall within the scope of the invention.

Figure 13:
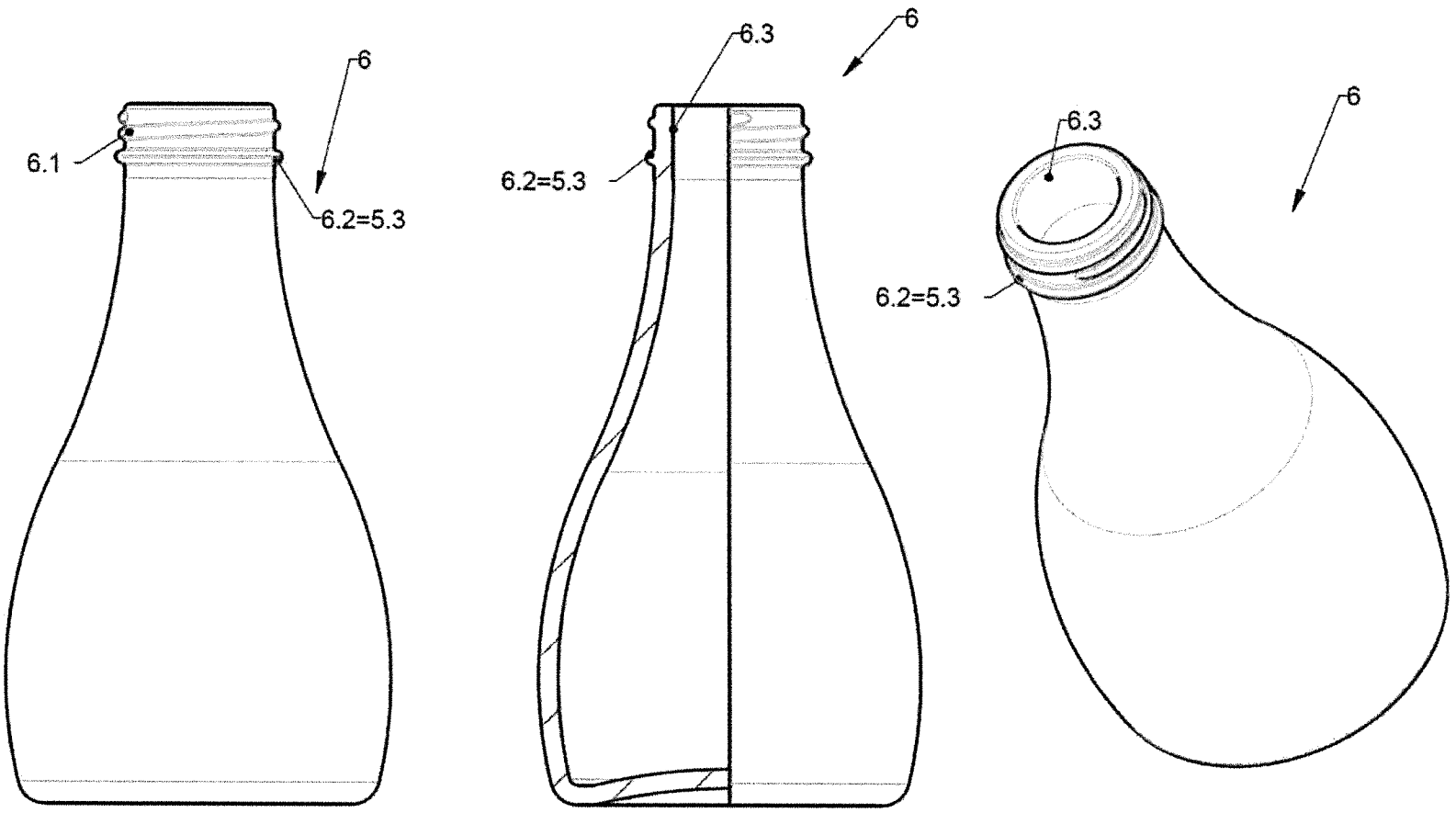
FIG. 13 is a detailed and sectional upper front side view of the inventive container with threading geometries like in the marketed version of the Kikkoman container.
Figure 14:
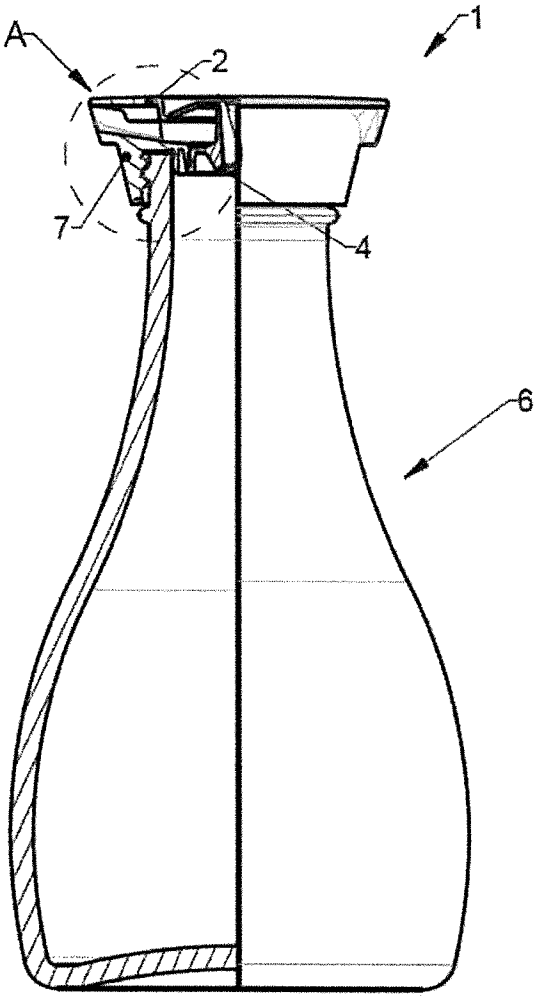
FIG. 14 is a series of views of the inventive plug in its version with screwing in the closing/transport/storage position.
Figure 14:
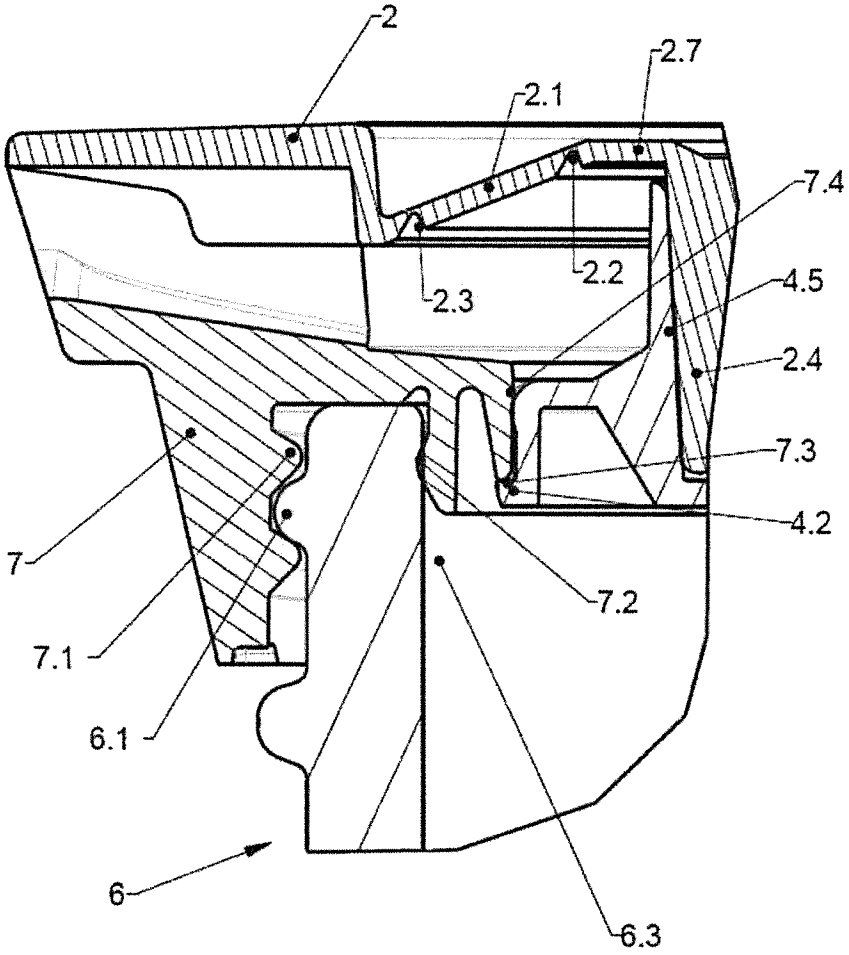

With reference to FIG. 13, a bottle 6 is shown with specific screw-type neck of the delivering plug 1 with a body with internal threading 7.1, useful for screwing (FIG. 14). Observing the detail of FIG. 13, there is an external threading 6.1 and a tooth 6.2 with spherical section, which is equal to the tooth 5.3, which is identical as size, geometry and position to the one which is currently found on the marketed bottles, and which is used to prevent having to modify the existing production cycle in any way. The internal diameter 6.3 performs a seal with the geometry of the main body 7 with screwing geometry 7.2 (FIG. 14). In this case, the removal-preventing of the plug 1 is not guaranteed, since the geometry of the currently marketed bottle is fully mimicked: it will therefore be necessary to possibly integrate the system with the heat shrinkable sleeve, which is optional and not shown, to guarantee for the customer that the plug has not been removed before its first opening. The big advantage of this version with main body 7 is that it can be easily adapted to the production cycle, replacing the current complex and cumbersome plug at managing level (FIGS. 16, 17 and 18). Therefore, there will be a "tamper evident" plug with automatic opening already ready to be adapted to the current production cycle without requiring modifications, but removing a big part of the above described defects of the original plug 0.1 (FIGS. 16, 17 and 18).

Figure 15:
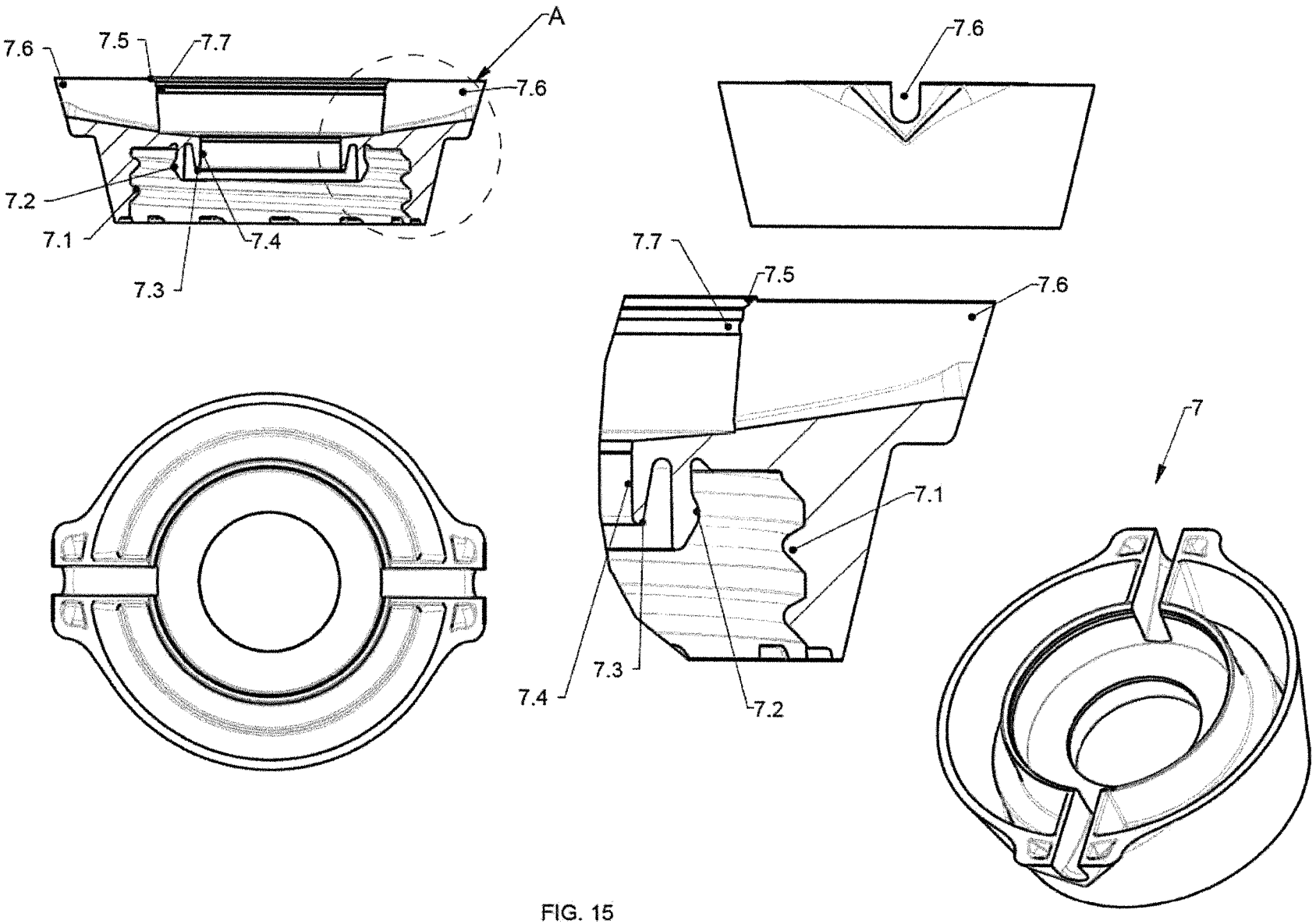
FIG. 15 is a detailed and sectional upper front side view of the main body of the inventive plug in its screwing configuration on a bottle neck on which there are geometries useful for screwing (threading)

With reference to FIG. 14, another embodiment is shown for the delivering plug, which is immediately adapted to the container marketed by Kikkoman. In this case, the body 7 (FIG. 15) has therein a threading 7.1 adapted to be stably coupled with the threading present on the existing bottle 6, more specifically with the geometry 6.1. In this case, the delivering plug 1 will be an exact exterior copy (as regards overall sizes), in order to be able to be immediately suited to the existing production steps, without requiring any modification for the customer or the manufacturer, but only technical arrangements given by the change of barycenter of the piece and of the weight.

In this case, there are all the advantages described for the previous embodiment, apart from the removal-preventing of the plug from the bottle, since it has been necessary to adapt the plug to an existing container lacking the necessary geometries. On this embodiment there is also another system 7.2 with flexible sealing lip between internal neck 6.3 of the bottle 6 and delivering plug 1, which can be manufactured also on the body 3 shown in FIG. 9. In this way, an additional OR-Ring is avoided, as instead occurs on the standard assembly 0.1 shown in FIGS. 16, 17 and 18.

The opening system with flexible and sealing membrane is the same one already described above. Therefore, briefly, the lower piston 4 is placed in its operating position on the body 7 due to the interference between the geometries 4.1 and 7.4, which are placed in the correct sealing position due to the step 4.2, which collides with the small lip 7.3 of the body 7. As can be noted, on the upper part of the piston 4, there is a guiding cylinder 4.3, which operates as seat for the lower part 2.4 of the upper cover with the collapsible push-button 2 and enables its displacement/opening in its use position, as described below. The upper cover with central collapsible push-button 2 which operates as "tamper evident" element is placed on the main body 7 oriented due to the geometries 2.6 which determine its right position, and is then stably welded thereto (hot or ultrasound welding).

The upper cover has a central push-button 2.1 which, due to the internal weakening points 2.3 and 2.2, can be moved, thanks to the central pressure which the end user/customer performs, from the closing position shown in FIG. 14 to the use/opening position (not shown), keeping this configuration, and therefore making the internal piston 4 remains open afterwards.

The delivering plug 7 with screwing body, when it is in its operating position (not shown) with the upper tamper evident element (central collapsible push-button) in its opening position, provides evidence (in favor of the end user) of a performed opening. The pressure applied to the central push-button 2.7 of the upper plug 2 (FIG. 10) collapses it in a controlled and symmetrical way. The weakening elements 2.2 and 2.3 allow an easy and controlled descent of the piston 4 due to the interference connection between the geometry 4.3 of the stem and the geometry 2.4 of the central push-button. The push-button, once collapsed in its opening position, remains stable in such position, providing three major benefits:

1. it is not necessary any more to remove the plug in order to remove the internal protection 0.5 (FIG. 16, 17), as happened in the prior art (described below with reference to FIGS. 16, 17 and 18), and therefore there is an immediate and automatic opening of the dispenser, due and guided by the controlled collapsing of the upper membrane of the plug 2;

2. the central push-button stably remains in its opening position and keeps the plug always open, without having to perform additional operations;

3. the user has no objects or wastes to be managed, as occurred in the original version when, at its first opening, heat shrinkable sleeve and sealing plug have to be removed and disposed of (creating garbage) for their transport and storage (FIGS. 16 and 17).

With reference to FIG. 14, the second embodiment of the main body of the inventive plug will be described in detail. This second embodiment 7, as previously explained, is stably assembled by means of a threading present on the neck of the container 6.1 and inside the body 7, specifically in the geometry 7.1. As can be noted, there are two elongated ends 7.6 which respectively operate as liquid outlet/air inlet, according to how the container will be inclined to deliver the liquid.

On the upper part of the main body 7, there is a sealing ring 7.7 which, once having assembled the plug, then cooperates with the chute 2.5 of the upper plug 2 with collapsible membrane, performing an operating liquid sealing. It can also be noted that there is a bit-shaped profile 7.5, which operates as energy guiding element and allows an ultrasound welding on the internal plane 2.9 of the upper plug 2 with collapsible membrane.

Internally, there is a central opening 7.4, which cooperates in operating sealing with the lower piston 4, due to the geometries 4.1 and 7.4. On the lower part, there is the threading 7.1, which is stably and operatively connected to the threading present on the neck 6.1 of the standard bottle 6 present on the market.

Moreover, there is the main internal sealing cone 7.2, which cooperates in an operating sealing position with the internal diameter 6.3 of the neck 6.1 of the bottle 6, generating a liquid seal without the need of using additional OR-rings, as instead occurred in the nowadays marketed version (FIGS. 16, 17 and 18).

With reference to FIGS. 16, 17, the currently marketed Kikkoman system is shown. It is, as previously described, a scarcely practical, not immediate and scarcely safe system 0.1, which plugs a glass container 6. It is composed of five pieces, which are the heat shrinkable sleeve (not shown), a simple upper plug 0.1, a main body 0.3, a sealing washer/OR-ring 0.6, and a sealing plug 0.5 for transport and storage.

With reference to FIG. 18, the plug 0.1 prepared by the customer (for the first delivery) can be observed in its opening position. It can be noted that, from the assembly, the lower plug 0.5 and the heat shrinkable sleeve have been manually removed by the customer (by disassembling the assembly previously shown in FIG. 16 and FIG. 17). This compels the end customer to create and to manage garbage. Moreover, the plug has no evidence of opening and can be used several times by filling the container with counterfeited liquid and creating damages to the consumer and to the manufacturer. Moreover, it is not hygienically correct to use again a plug and a container which have been already used.

Finally, for both embodiments of the inventive plug 1, it will be possible to add a seal-type plug (not shown) on the upper part of the above described delivering plug 1 (both in its embodiment with removal-preventing/anti-counterfeiting engagement on a bottle, and in its second embodiment with a screwing-type plug on a marketed bottle), such seal plug further protecting the collapsible push-button from accidental openings and simultaneously the two liquid outlet/air inlet holes from the dust, and which will have to be removed as first operation before actuating/opening the delivering plug 1. Alternatively, the heat shrinkable sleeve can be applied, like in the currently marketed plug.

The invention claimed is:

1. A container for liquids equipped with a delivering plug, the delivering plug comprising a main body placed at a delivery end of the container, a lower closing piston inside the main body, from a side oriented towards inside the container, and an upper cover with a collapsible membrane/push-button placed inside the main body, from a side oriented towards outside the container, the upper cover with the collapsible membrane/push-button fastened to the main body comprising a central push-button equipped with internal elements, to allow deforming the central push-button passing from a closing position to a stable using/opening position, the main body comprising two elongated ends adapted to operate as a liquid outlet and/or an air inlet, according to how the container is inclined to deliver the liquid, wherein the main body comprises a sealing ring adapted to cooperate with a chute of the upper cover with collapsible push-button to perform an operative liquid sealing, and the upper cover with central collapsible push-button is welded to the main body, after positioning the plug on the main body in a manner oriented with respect to the liquid outlet and to the air inlet due to geometries, an internal plane of component allowing to bit-shaped elements to accurately discharge thereon the welding energy or heat, and, in case of ultrasound welding, operating as energy guiding element to allow the final, unmovable and operating welding and a liquid sealing.

2. The container of claim 1, wherein the lower closing piston comprises a step abutting against an edge of the main body, to be able to place in a correct sealing position the lower closing piston with respect to the main body, through respective interference profiles.

3. The container of claim 1, wherein the lower closing piston comprises a guiding cylinder adapted to house a lower part of the upper cover with collapsible membrane/push-button, to enable the displacement/opening in its use position.

4. The container of claim 1, wherein the main body comprises a fastening tooth stably and operatively connected to removal-preventing geometries of the neck of the container.

5. The container of claim 4, wherein the main body comprises a main internal sealing cone adapted to cooperate with an internal diameter of the neck of the bottle, in an operating sealing position, to be able to generate a liquid sealing without additional OR-rings.

6. The container of claim 5, wherein the container internally comprises a reduction of the internal diameter as safeguard of a sealing diameter.

7. The container of claim 1, wherein the container comprises at least two external teeth with sharped edge, the tooth operating to keep the plug in position and axial, the tooth being used to cooperate with an internal tooth of the main body, guaranteeing its seal and the removal-preventing of the delivering plug.

* * * * *